US007648026B2

(12) United States Patent
Brittain

(10) Patent No.: US 7,648,026 B2
(45) Date of Patent: Jan. 19, 2010

(54) PACKAGING ASSEMBLY FOR CONTAINING AND SHIPPING ARTICLES

(75) Inventor: Jody S. Brittain, North Augusta, SC (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 382 days.

(21) Appl. No.: 11/611,349

(22) Filed: Dec. 15, 2006

(65) Prior Publication Data

US 2007/0131571 A1 Jun. 14, 2007

Related U.S. Application Data

(63) Continuation-in-part of application No. 11/159,750, filed on Jun. 23, 2005, now Pat. No. 7,543,703.

(51) Int. Cl.
*B65D 85/00* (2006.01)

(52) U.S. Cl. ..... 206/320; 206/446

(58) Field of Classification Search ..... 206/320, 206/321, 326, 446, 448, 449, 451, 453, 454, 206/477, 21, 591, 586, 55, 389, 414; 108/51.3, 108/55.1, 55.3, 55.5, 57.34
See application file for complete search history.

(56) References Cited

U.S. PATENT DOCUMENTS

| | | | | |
|---|---|---|---|---|
| 2,321,063 | A | | 6/1943 | Bohnke |
| 2,706,099 | A | * | 4/1955 | Whalley ..... 108/53.3 |
| 2,804,253 | A | | 8/1957 | Brandt |
| 2,932,438 | A | | 4/1960 | Smith |
| 2,936,880 | A | | 5/1960 | Kohlhaas |
| 2,953,339 | A | * | 9/1960 | Roshon ..... 108/51.3 |
| 3,107,780 | A | | 10/1963 | Stuckert |
| 3,362,609 | A | | 1/1968 | Freedy |
| 3,470,832 | A | * | 10/1969 | Heffernan ..... 108/53.3 |
| 3,752,384 | A | | 8/1973 | Siburn |
| 4,019,672 | A | | 4/1977 | Giannini |
| 4,130,199 | A | | 12/1978 | Sorenson |
| 4,375,261 | A | | 3/1983 | Kitchell |
| 4,919,306 | A | | 4/1990 | Heaps, Jr. et al. |
| 4,955,474 | A | | 9/1990 | Mattingly et al. |

(Continued)

FOREIGN PATENT DOCUMENTS

DE 9310122 9/1993

OTHER PUBLICATIONS

International Search Report for PCT/US2006/062159 mailed Mar. 15, 2007.

*Primary Examiner*—J. Gregory Pickett
(74) *Attorney, Agent, or Firm*—Joel T. Charlton

(57) ABSTRACT

Disclosed is a packaging assembly for securing an item in a carton. A top cap, a bottom pad and if desired, one or more middle pads, each include a board and a plurality of clips secured to the board. The clips are arranged to engage the item at spaced apart locations around the top and bottom portion of the item, respectively. In an alternative embodiment, one of the legs of one or more of the clips has a ledge projecting outwardly to engage a surface of the item. In yet another embodiment, only one of the top cap and bottom pad includes clips to position and retain the item in the carton. In addition, the multiple clips may be formed as an integral unit.

19 Claims, 16 Drawing Sheets

U.S. PATENT DOCUMENTS 5,509,534 A 4/1996 Taravella et al.
5,862,911 A 1/1999 Phillips, II et al.
6,126,002 A 10/2000 Brown et al.
6,237,838 B1 5/2001 Bradenbaugh

* cited by examiner

PACKAGING ASSEMBLY FOR CONTAINING AND SHIPPING ARTICLES

This application is a continuation-in-part of U.S. application Ser. No. 11/159,750 filed Jun. 23, 2005, the entire contents of which are hereby expressly incorporated herein by reference.

TECHNICAL FIELD

The present invention generally relates to a packaging assembly for properly positioning and thus protecting an appliance, such as a water heater, or other item in a shipping container during shipping and handling. More specifically, this invention relates to a paperboard pad having clips disposed thereon to properly position and hold in place various items that are shipped and handled via various types of shipping containers.

BACKGROUND OF THE INVENTION

Large appliances, e.g., water heaters, air conditioning units and the like, are particularly difficult to package to prevent damage during shipping and handling. Typically, large appliances use packaging assemblies that are bulky and take a lot of storage space. Further, the packaging assemblies are usually discarded after the appliances are delivered and cannot be reused. Thus, there is a need in the industry to provide a packaging assembly that is not bulky, saves storage space, is inexpensive and can be reused after delivery of the appliance.

In addition to large appliances, other items that are packaged and shipped can benefit from having a packaging assembly that is not bulky and can be reused. Moreover, items that are shipped come in all shapes and sizes and many of these items have a smaller profile than a large appliance. It would be desirable for certain types of these smaller items to be positioned in a shipping container and held in place during shipping and handling. This would help to prevent damage to the item, allow better use of the volume in the shipping container, and present a more organized arrangement of the item to the customer for use when the item arrives at the desired destination. Examples of such smaller items that can be shipped with the packaging assembly of this invention include, but are not limited to, spools of filamentary material, such as nylon.

SUMMARY OF THE INVENTION

Embodiments of the present invention provide a packaging assembly that positions and retains various items in a shipping container. In one embodiment, the packaging assembly has a top cap and bottom pad each including a board and at least one but preferably a plurality of clips secured to the board. The clips of the top cap and the bottom pad are arranged to engage the item at spaced apart locations around the top and bottom, respectively. Depending on the type of item to be shipped, the clips can be located such that they engage the outside of the periphery of the item or an inner wall portion of the item. Each clip has two legs, with each leg having a foot that projects outwardly from the leg. Each foot is preferably sandwiched between two boards to hold the clip in position. The top and bottom clips have a generally V-shaped or U-shaped configuration, but can be oriented so the V or U is inverted, i.e. upside down. The clips can be symmetrical or one of the legs could be shorter or longer than the other leg. The exact configuration and orientation will be determined by the type of item to be held in place by the packaging assembly of this invention.

In an alternative embodiment, one of the legs of each of the top or bottom clips, or both, has a ledge projecting outwardly from the leg to engage a generally flat portion of the item. Other configurations for the clip can be used depending on the surface configuration of the item to be shipped to ensure secure engagement by the clip thereto. In addition, depending on the item to be shipped, only one of the top cap or bottom pad need be used with the clips to properly position and retain the item. For example, the top cap or the bottom pad can be replaced with a current roll-up design or molded foam. Typically, the roll-up design is a die cut where some assembly by a user is required prior to use.

The packaging assembly and item to be shipped can be enclosed by a typical shipping container. The container includes top, bottom, and side walls, with the packaging assembly holding in place the item to be shipped and preventing the item from contacting the top, bottom and side walls of the shipping container. Alternatively, the packaging assembly can include a bottom, intermediate layer(s) and a top that may all then be wrapped in a shrink wrap material. This assembly can be placed in a standard shipping container or otherwise transported to the desired destination.

Other systems, methods, features, and advantages of the present invention will be or become apparent to one with skill in the art upon examination of the following drawings and detailed description. It is intended that all such additional systems, methods, features, and advantages be included within this description, be within the scope of the present inventions and he protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Disclosed is a packaging assembly for securing various items, including but not limited to an appliance, a spool-type arrangement of filamentary material, where the spool may be hollow, or other item, in a shipping container. The term "appliance" can include, but is not limited to, water heater, refrigerator, washer, dryer, microwave, stove, oven, air conditioner and outdoor grill. In one embodiment, the packaging assembly comprises a top cap and bottom pad. The top cap and bottom pad each include at least one but preferably at least two boards, which are preferably corrugated, and at least one but preferably a plurality and even more preferably at least three clips secured to the boards. The clips are arranged to engage the item at spaced apart locations. In one embodiment, the clips engage the item around the periphery adjacent its top and bottom. Alternatively, the clips can engage an inner portion of the item to position and retain the item in the packaging assembly.

Exemplary packaging assemblies are discussed with reference to the figures. Although the assemblies are described in detail, the assemblies are provided for purposes of illustration only and various modifications are feasible. The item shown in the figures has a cylindrical configuration; however, the item can have other cross sectional shapes such as rectangular, square, triangular, or it can be asymmetrical.

Figure 1:
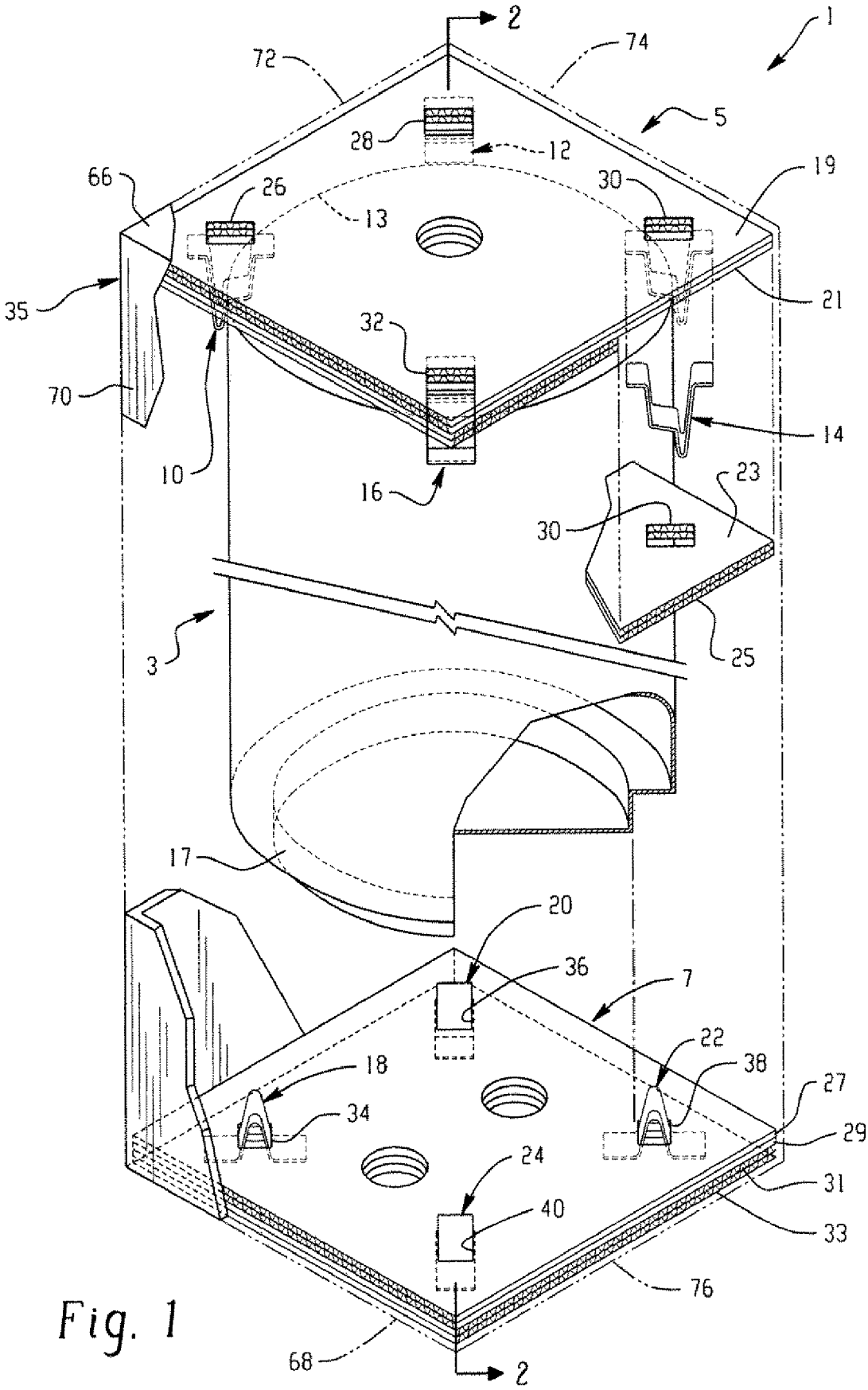
FIG. 1 is an exploded, cut-away, perspective view of an embodiment of a shipping container with the packaging assembly of this invention positioning and retaining an appliance in the shipping container.

Referring now in more detail to the figures in which like reference numerals identify corresponding parts, FIG. 1 is an exploded perspective view of an embodiment of a shipping container and packaging assembly. An item, such as an appliance or more specifically a water heater, is positioned, retained and thus protected by the packaging assembly of this invention that includes a top cap 5 that is positioned on top of item 3. The top cap 5 includes corrugated boards 19, 21, 23, 25 that are secured together by, for example, glue or lamination, and top clips 10, 12, 14, 16 that are secured to the corrugated boards 19, 21, 23, 25 through apertures 26, 28, 30, 32, respectively.

The top clips 10, 12, 14, 16 are arranged to engage the item 3 at spaced apart locations around the periphery 13 of the top of the item 3. A cut out of corrugated boards 23, 25 from the top cap 5 is shown in FIG. 1 illustrating the aperture 30 that is formed in the corrugated boards 19, 21, 23, 25. The top clip 14 passes into the aperture 30 in corrugated boards 23, 25 and is secured in place by corrugated boards 21, 23. The aperture 30 enables a plurality of top caps 5 to be nested on top of each other prior to or after use, which is illustrated and described in relation to FIG. 5.

The item 3 is positioned and retained on a bottom pad 7 secured with bottom clips 18, 20, 22, 24 that are passed into apertures 34, 36, 38, 40, respectively. The pad 7 is made of corrugated boards 27, 29, 31, 33 that are secured together by, for example, glue or lamination. It should be noted that the corrugated boards 19, 21, 23, 25, 27, 29, 31, 33 of the top cap 5 and bottom pad 7 preferably have the direction of the corrugation normal to the adjacent board in the top cap 5 or bottom pad 7.

The bottom clips 18, 20, 22, 24 are arranged to engage the item 3 at spaced apart locations around the periphery 17 of the bottom of the item 3. The bottom clips 18, 20, 22, 24 pass into the apertures 34, 36, 38, 40 of corrugated boards 27, 29, respectively, and are secured by the corrugated boards 29, 31. The apertures 34, 36, 38, 40 enable a plurality of bottom caps 7 to be nested on top of each other prior to or after use, which is illustrated and described in relation to FIG. 6. The top 10, 12, 14, 16 and bottom 18, 20, 22, 24 clips are spaced apart at least at substantially equidistant locations on the top cap 5 and bottom pad 7. While four top clips on the top cap and four bottom clips on the bottom pad are preferred, it is feasible to have only three clips on each top cap 5 and bottom pad 7. In addition, fewer than three clips on each cap 5 and pad 7 could be used. The number of clips will be determined by the shape of the item to be shipped and the need to position the item and retain the item in position with respect to the packaging assembly or the shipping container. In addition, although the foregoing embodiment includes clips in both the top cap 5 and the bottom pad 7, it is within the scope of this invention to have the clips located in only one or the other of the top cap 5 or the bottom pad 7. Again, the need for clips in either one or both of the top cap 5 and bottom pad 7 will be determined by the ability of the clips to position the item and retain the item in position with respect to the shipping container.

The item 3 can be enclosed by a shipping container 35 in which the packaging assembly with the retained item 3 is positioned. The item 3 is secured in shipping container 35 by the top cap 5 and bottom pad 7. The shipping container 35 has a top 66, bottom 68 and side walls 70, 72, 74, 76, with the top cap 5 and bottom pad 7 preventing the item 3 from contacting the top 66, bottom 68 and side walls 70, 72, 74, 76 of the shipping container 35.

Figure 2:
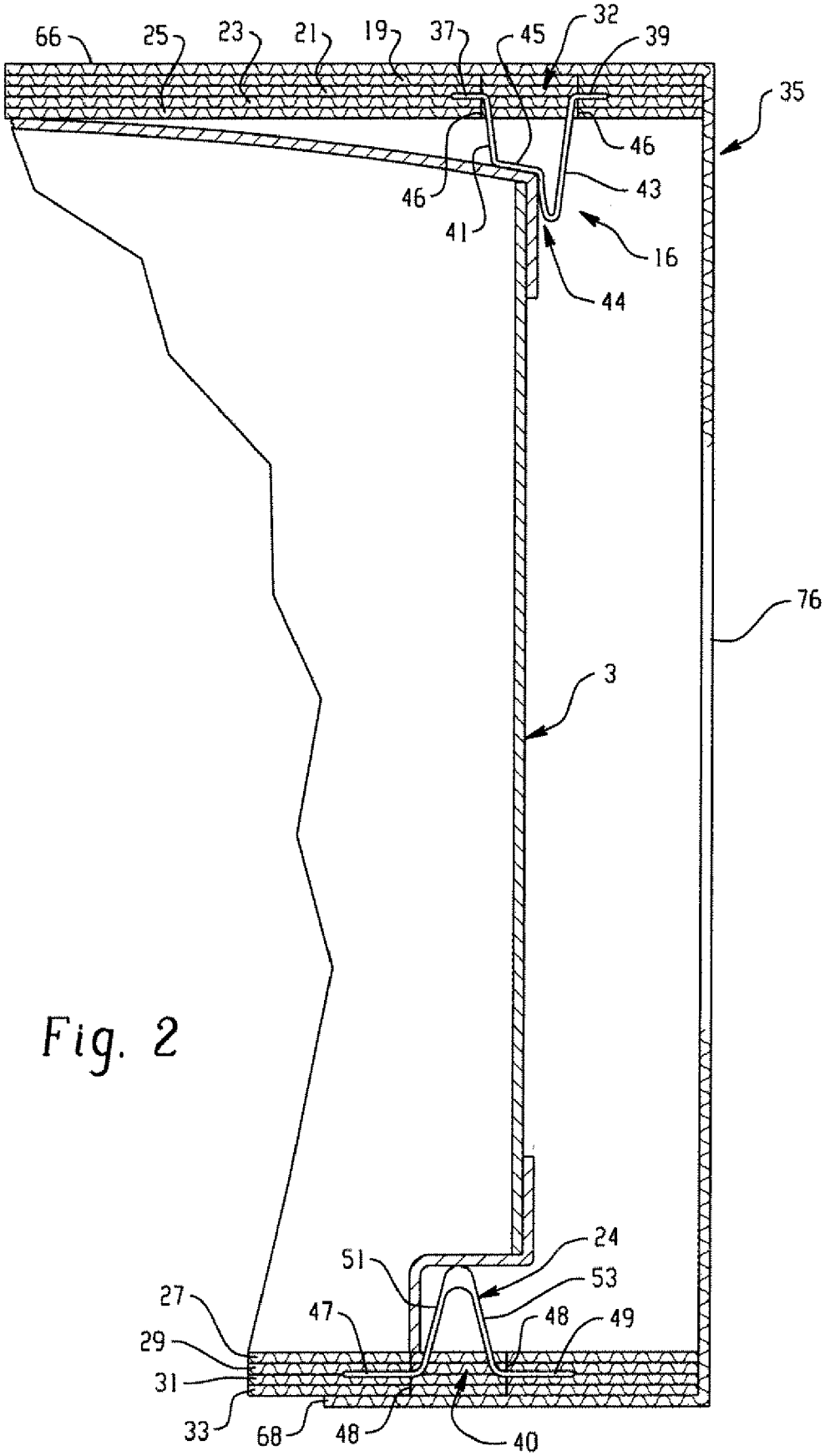
FIG. 2 is a cross-sectional view of a portion of the embodiment of FIG. 1 along lines 2-2.

FIG. 2 is a partial cross-sectional view of an embodiment of the packaged item along lines 2-2 of FIG. 1. The top and bottom clips 16, 24 include respective legs 41, 43, 51, 53. Bottom clip 24 has a generally V-shaped configuration where the V is upside down with the apex pointing toward top cap 5. The leg 41 of the top clip 16 has a ledge 45 projecting outwardly from the top clip 16 to engage the top edge 44 of the item 3. Each of the legs 41, 43, 51, 53 has a foot 37, 39, 47, 49, respectively, that projects outwardly from the legs 41, 43, 51, 53. The tip or apex of the V of the bottom clip 24 can engage the bottom portion of the appliance 3 as shown in FIG. 2. Alternatively, bottom clip 24 could include a ledge similar to ledge 45 of top clip 16 if bottom clip 24 had a larger height so it could engage the outer wall of item 3 and the lower horizontal surface thereof. Such a ledge would facilitate secure engagement between bottom clip 24 and item 3. It is to be understood that other shapes for top and bottom clips 16, 24 could be used to engage the item positioned and retained in the carton. In addition, the legs of each clip could have a different length making the clip asymmetrical.

The feet 37, 39, 47, 49 of the top and bottom clips 16, 24 are sandwiched between corrugated boards 21, 23 of the top cap 5 and corrugated boards 29, 31 of the bottom pad 7, respectively. The top and bottom clips 16, 24 pass into aperture 32 of corrugated boards 23, 25 and aperture 40 of corrugated boards 27, 29 to hold the top and bottom clips 16, 24 in position, respectively. The legs 41, 43, 51, 53 of the top and bottom clips 16, 24 are spaced apart from each other such that the legs 41, 43, 51,53 are adjacent to the walls 46, 48 of the apertures 32, 40, respectively. The caliper of the corrugated boards 21, 23, 29, 31 can be lowered around the area where the feet 37, 39, 47, 49 of the top and bottom clips 16, 24 reside between the corrugated boards 21, 23 of the cap 5 and corrugated boards 29, 31 of the pad 7, respectively. The reduction of the caliper around these areas gives a recessed area for the feet 37, 39, 47, 49 of the clips 16, 24 so the thickness of the clips 16, 24 does not prevent board-to-board contact of the corrugated boards 19, 21, 23, 25, 27, 29, 31, 33 during the gluing or laminating operation. Although the foregoing description of the shape, configuration and size of the top and bottom clips identifies only clips 16 and 24, it is to be understood that the description applies to all of top clips 10, 12, 14, 16 and all of bottom clips 18, 20, 22, 24.

Figure 3:
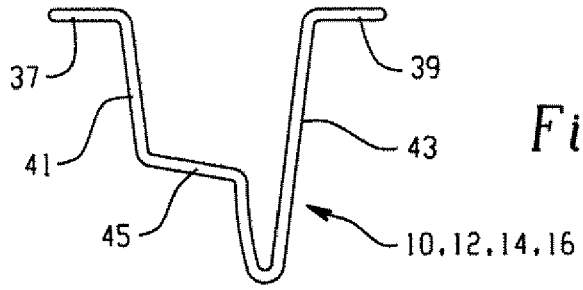
FIG. 3 is a side view of an embodiment of a clip that may be used with the top cap as shown in FIG. 1.
Figure 4:
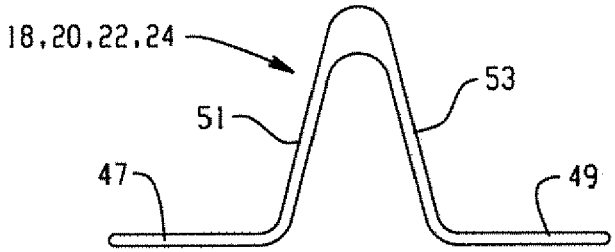
FIG. 4 is a side view of an embodiment of a clip that may be used with the bottom pad as shown in FIG. 1.

The top clips 10, 12, 14, 16 and bottom clips 18, 20, 22, 24 are further illustrated in FIGS. 3 and 4, respectively, which are side views of an embodiment of the top and bottom clips as shown in FIG. 1. The top clips 10, 12, 14, 16 and bottom clips 18, 20, 22, 24 are preferably constructed of plastic, although other tough and strong materials, such as metal, could be used. It is to be understood that even though reference is made to the top clips and the bottom clips, the indication of top or bottom is for ease of reference only and the configuration of the clips is not exclusively for either the top or bottom but could be used in other locations in the packaging assembly.

In an alternative embodiment, the bottom pad 7 shown in FIGS. 1 and 2 could be used at both the top and bottom of the item 3, such that the bottom pad 7 could replace the top cap 5. In yet another embodiment, the top cap 5 shown in FIGS. 1 and 2 could be used at both the top and bottom of the item 3, such that the top cap 5 could replace the bottom pad 7. In yet another embodiment, either the top cap 5 or bottom pad 7 could be replaced with a current roll-up design or molded foam, such that only one of the top cap and bottom pad would be used as the packaging assembly.

One way, among others, to package the item 3 is to first place the item 3 on the bottom pad 7 and then place the top cap 5 on top of the item 3. A strap (not shown) can be used to strap the top cap 5, item 3, and bottom pad 7 together. The strapped item can then be loaded into the shipping container 35. Alternatively, the item 3 can be placed on the bottom pad 7 and the top cap 5 placed on top of the item. The shipping container 35 can then be assembled around the retained item 3 and glued together. It should be noted that the foregoing ways of packaging the item 3 are applicable to the alternative embodiments mentioned above, i.e., bottom pad 7 being used at both the bottom and top of the item 3, top cap S being used at both the bottom and top of the item 3, and either the top cap 5 or bottom pad 7 being replaced with a current roll-up design or molded foam.

Figure 5:
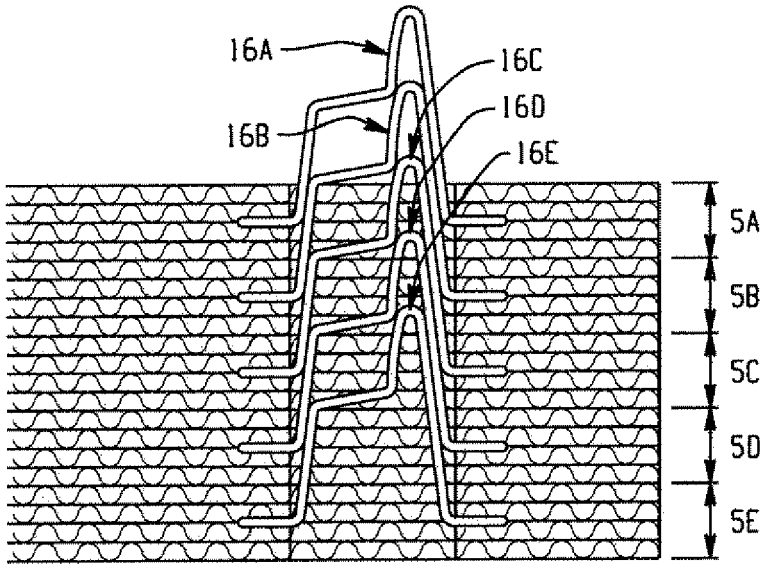
FIG. 5 is a side view of a portion of a plurality of top caps as shown in FIG. 1 that are nested on top of each other.
Figure 6:
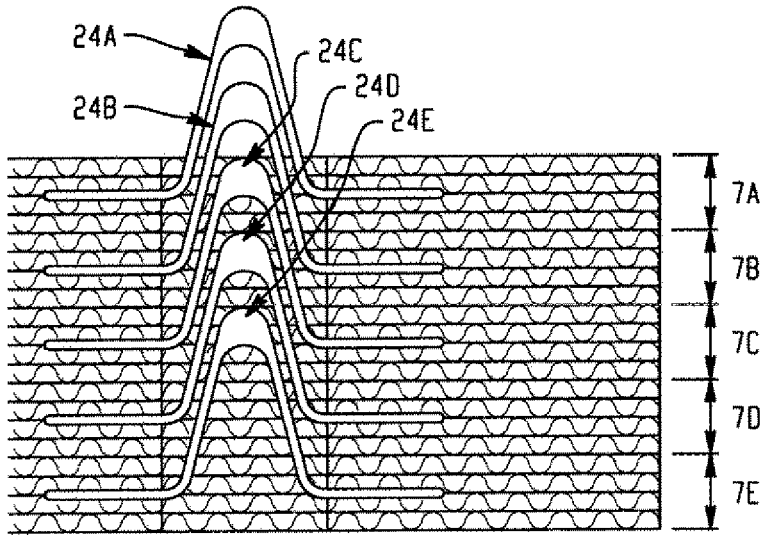
FIG. 6 is a side view of a portion of a plurality of bottom pads as shown in FIG. 1 that are nested on top of each other.

FIG. 5 is a side view of a portion of a plurality of the top caps as shown in FIG. 1 that are nested on top of each other. FIG. 6 is a side view of a portion of a plurality of the bottom pads as shown in FIG. 1 that are nested on top of each other. A plurality of top caps 5 and bottom pads 7 are stackable upon each other, respectively. Referring to FIG. 5, the top clips 16B, 16C, 16D, 16E are nested inside the corresponding clips 16A, 16B, 16C, 16D, respectively, in the top caps 5A, 5B, 5C, 5D immediately above in a stack of top caps 5A, 5B, 5C, 5D, 5E. Referring to FIG. 6, the bottom clips 24B, 24C, 24D, 24E are nested inside the corresponding clips 24A, 24B, 24C, 24D, respectively, in the bottom pads 7A, 7B, 7C, 7D immediately above in a stack of bottom pads 7A, 7B, 7C, 7D, 7E.

Figure 7:
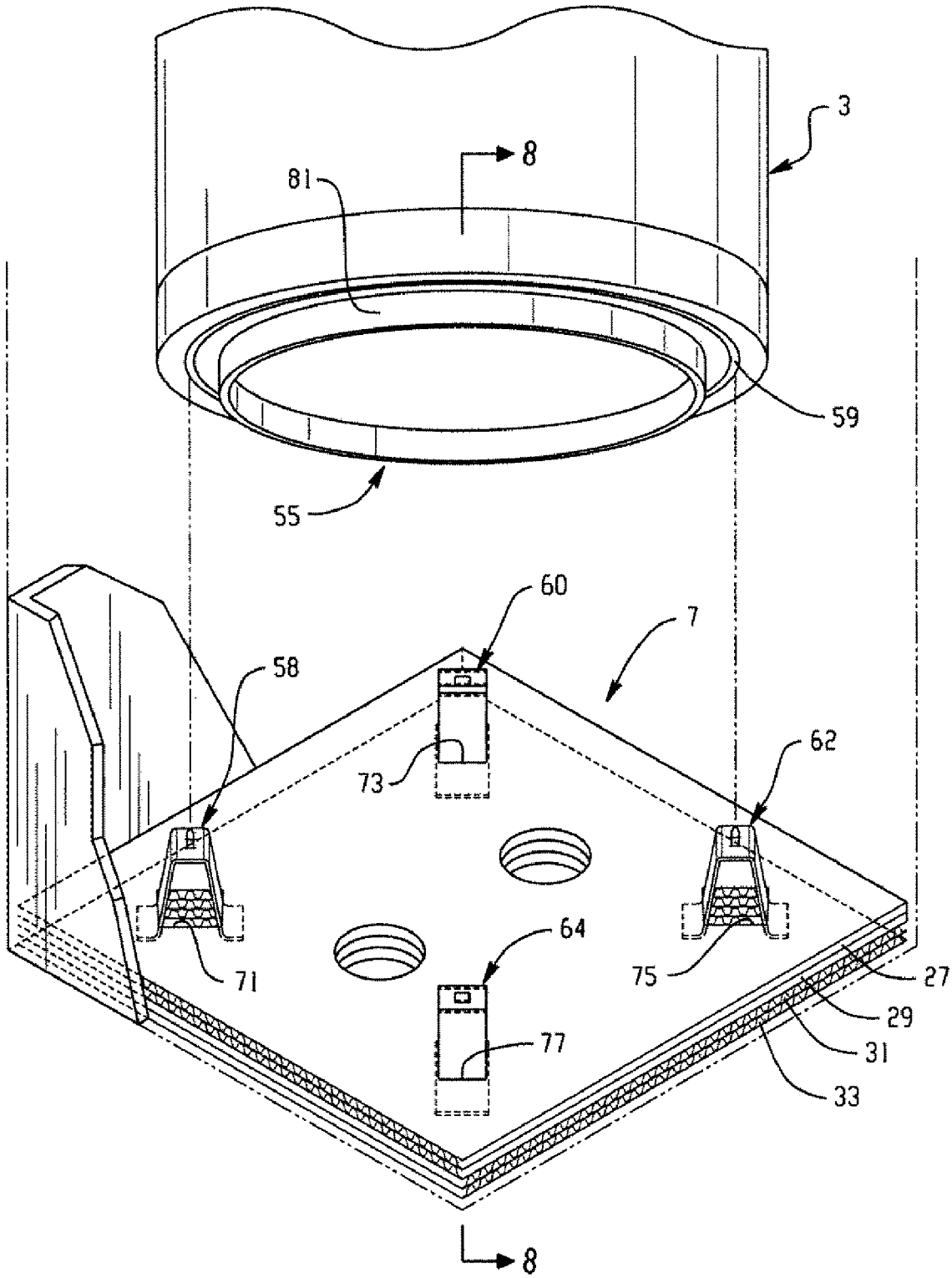
FIG. 7 is an exploded, cut-away, perspective view of an embodiment of the lower portion of the packaging assembly as shown in FIG. 1 where the bottom pad includes bottom clips with a projection on the top of the clip engaging a recess in the appliance.

FIG. 7 is an exploded perspective view showing an embodiment of the lower portion of the packaged item as shown in FIG. 1, where the bottom pad includes bottom clips with a projection on top of each clip. In this embodiment, the item 3 is placed inside a retained base pan 55, thus positioning and retaining the bottom portion of the item 3. The bottom clips 58, 60, 62, 64 are arranged at spaced apart locations around the bottom periphery 81 of the base pan 55. Each of the bottom clips 58, 60, 62, 64 includes a projection 61 on its top 79 (shown more specifically in FIGS. 8 and 9) that engages a recessed portion 59 of the base pan 55 to hold the base pan 55 in a retained position. The recessed portion 59 may be a groove having a generally arcuate cross section disposed at the bottom of the base pan 55. It should be noted that other cross sections for the groove are applicable such as rectangular, square, triangular, or asymmetrical. Depending on the item 3 to be packaged, it is within the scope of this invention to include such projections on one or more of top clips 10, 12, 14, 16 as well In an alternative embodiment the projections 61 of bottom clips 58, 60, 62, 64 engage slots 83, 87, 85, respectively, as shown in FIG. 10. It is to be noted that a fourth slot is also located at the bottom of the base pan, but is hidden from view in FIG. 10. This hidden slot would engage the projection of clip 60. Each slot 83, 85, 87 (including the hidden slot) is formed as a cut-out in the bottom of the base pan 55, The embodiments of the recessed portion 59 and the slots 83, 85, 87 (including the hidden slot) maintain the item 3 at a desired distance between the outside of the item 3 and the side walls of the shipping container 35. The embodiment using the slots 83, 85, 87 (including the hidden slot) further prevents the item 3 from rotating within the shipping container 35. Again, it is within the scope of this invention to include such projections on one or more of top clips 10, 12, 14, 16 as well. In addition, it is not necessary to include projections on the top of each clip. It is within the scope of this invention to include projections on the top of only one, two or three of the clips.

The bottom clips 58, 60, 62, 64 in both embodiments shown in FIGS. 7 and 10 pass into the apertures 71, 73, 75, 77 of corrugated boards 27, 29, respectively, and are secured between the corrugated boards 29, 31. The apertures 71, 73, 75, 77 of corrugated boards 27, 29, 31, 33 enable a plurality of bottom caps to be nested on top of each other prior to or after use, which is illustrated and described in relation to FIG. 9. The base pan 55 is shown to have a circular shape; however, the base pan 55 can have other shapes such as rectangular, square, triangular, or it can be asymmetrical.

Figure 8:
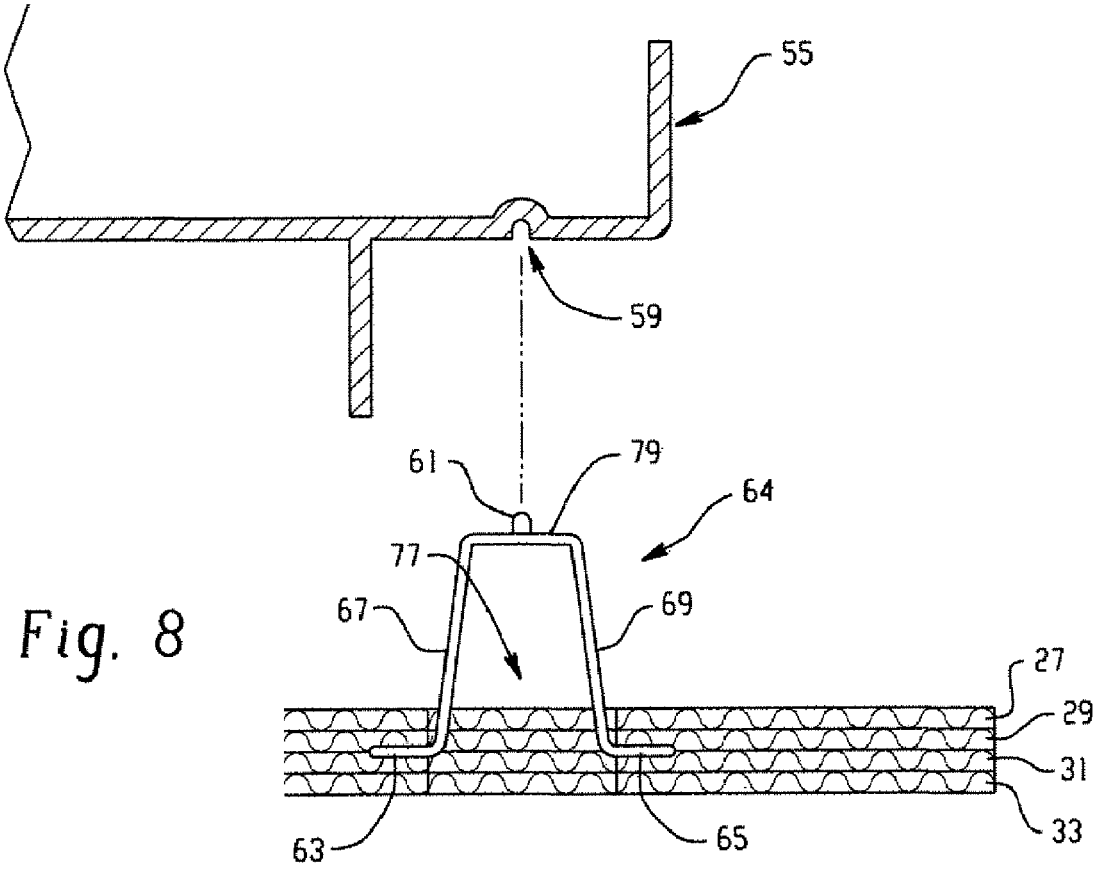
FIG. 8 is an exploded side view of a portion of the embodiment of FIG. 7.

FIG. 8 is an exploded side view of an embodiment of a portion of the lower portion of the packaged item as shown in FIG. 7. The bottom clip 64 includes base or top 79 and legs 67, 69, that are arranged in a generally U-shaped configuration. The apex or top 79 of the bottom clip 64 has a projection 61 projecting outwardly from the bottom clip 64. Each of the legs 67, 69 has a foot 63, 65 that projects outwardly from the legs 67, 69, respectively. Each foot 63, 65 is sandwiched between corrugated boards 29, 31 of the pad 7 through aperture 77 of corrugated boards 27, 29, respectively, to hold the bottom clip 64 in position. The projection 61 is remote from the ends of the legs to which the feet 63, 65 are attached for engaging the recessed portion 59 of the base pan 55. It is within the scope of this invention that top clips 10, 12, 14, 16 also have a similar configuration as described above.

Figure 9:
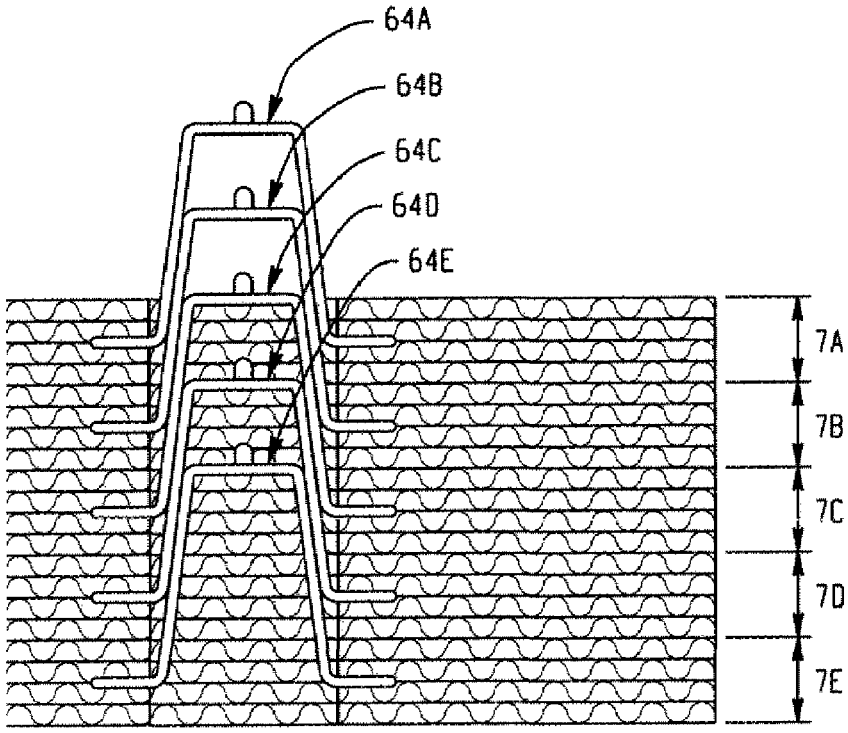
FIG. 9 is a side view of a portion of a plurality of the bottom pads as shown in FIG. 7 that are nested on top of each other.
Figure 10:
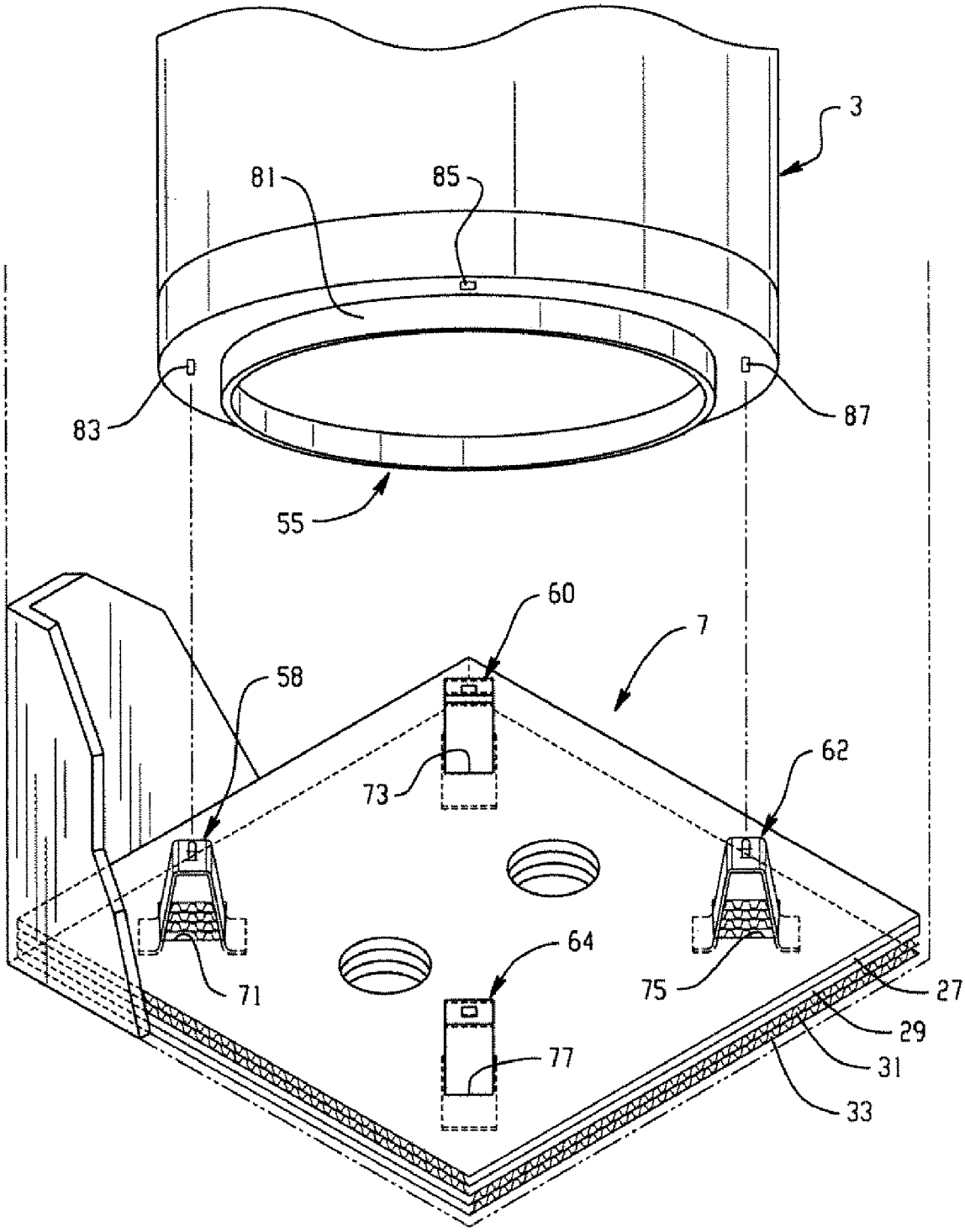
FIG. 10 is an exploded, cut-away, perspective view of an embodiment of the lower portion of the packaging assembly as shown in FIG. 1 where the bottom pad includes bottom clips with a projection on the top of the clip engaging a slot in the appliance.

FIG. 9 is a side view of a portion of an embodiment of the bottom pads as shown in FIG. 7 that are nested on top of each other. A plurality of the bottom pads 7 is stackable upon each other. The bottom clips 64B, 64C, 64D, 64E are nested inside the corresponding clips 64A, 64B, 64C, 64D, respectively, in the bottom pads 7A, 7B, 7C, 7D immediately above in a stack of bottom pads 7A, 7B, 7C, 7D, 7E.

FIGS. 11 through 22 show other embodiments of the packaging assembly of this invention for positioning and retaining various sized and shaped items in a shipping container. It is to be understood that the description of the configuration, orientation and arrangement of the top and bottom clips, the corrugated boards and pads to which the clips are connected of the previous embodiments apply equally to the following description of the embodiments of FIGS. 11 through 22.

Figure 22:
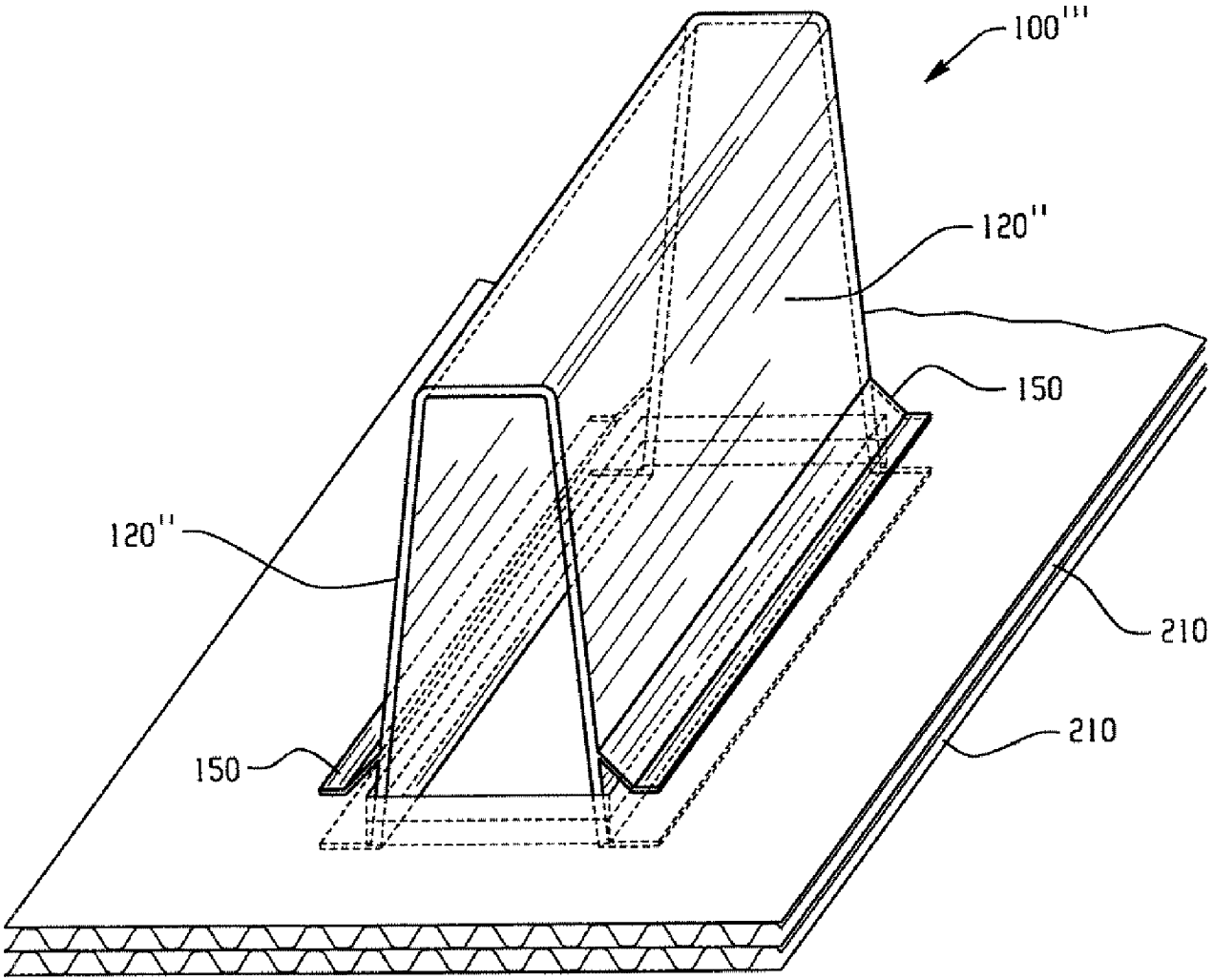
FIG. 22 is an enlarged perspective view of another embodiment of the clip for use in the packaging assembly of this invention.

The clips 100 have a generally V- or U-shaped configuration with the legs 120 extending from an apex 110 to feet 130 extending outwardly from legs 120. This configuration is substantially similar to the configuration shown in FIG. 4, The V or U can be oriented upside down, depending on where the clip is located in the packaging assembly of this invention. Although clips 100 have a symmetrical configuration with each of legs 120 of equal length, an alternate embodiment includes legs 120' that have different lengths resulting in a clip 100' with an asymmetric configuration. See FIG. 19. In addition, as shown in FIG. 22, separate fins 150 may extend outwardly from legs 120" adjacent to feet 130. Fins 150 engage the top surface of the corrugated boards 210 to help hold clips 100" in place.

Figure 14:
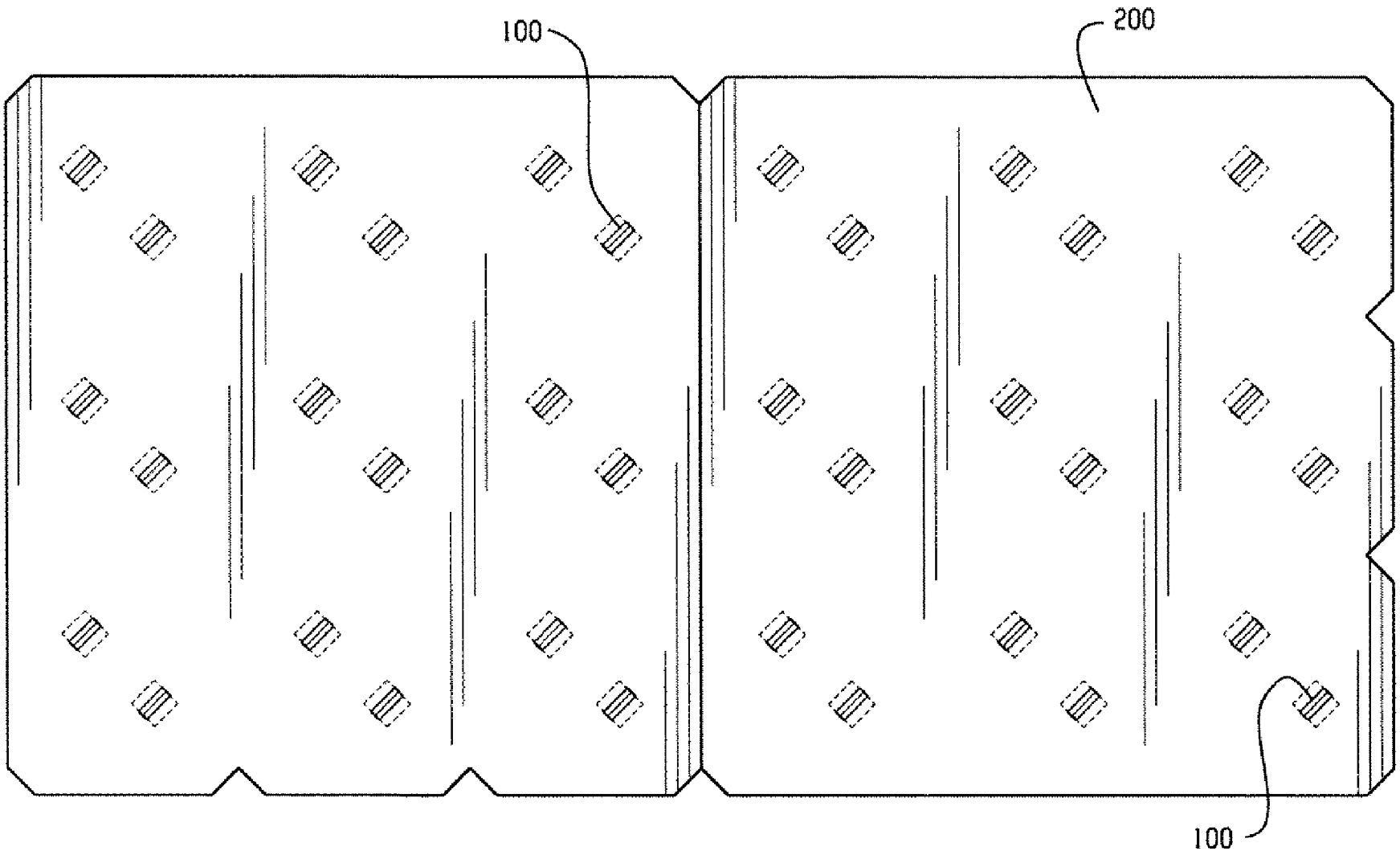
FIG. 14 is a plan view of the top cap or bottom pad of the packaging assembly of FIG. 11 showing the location of pairs of clips used thereon to maintain and position smaller items with respect to the packaging assembly.
Figure 15:
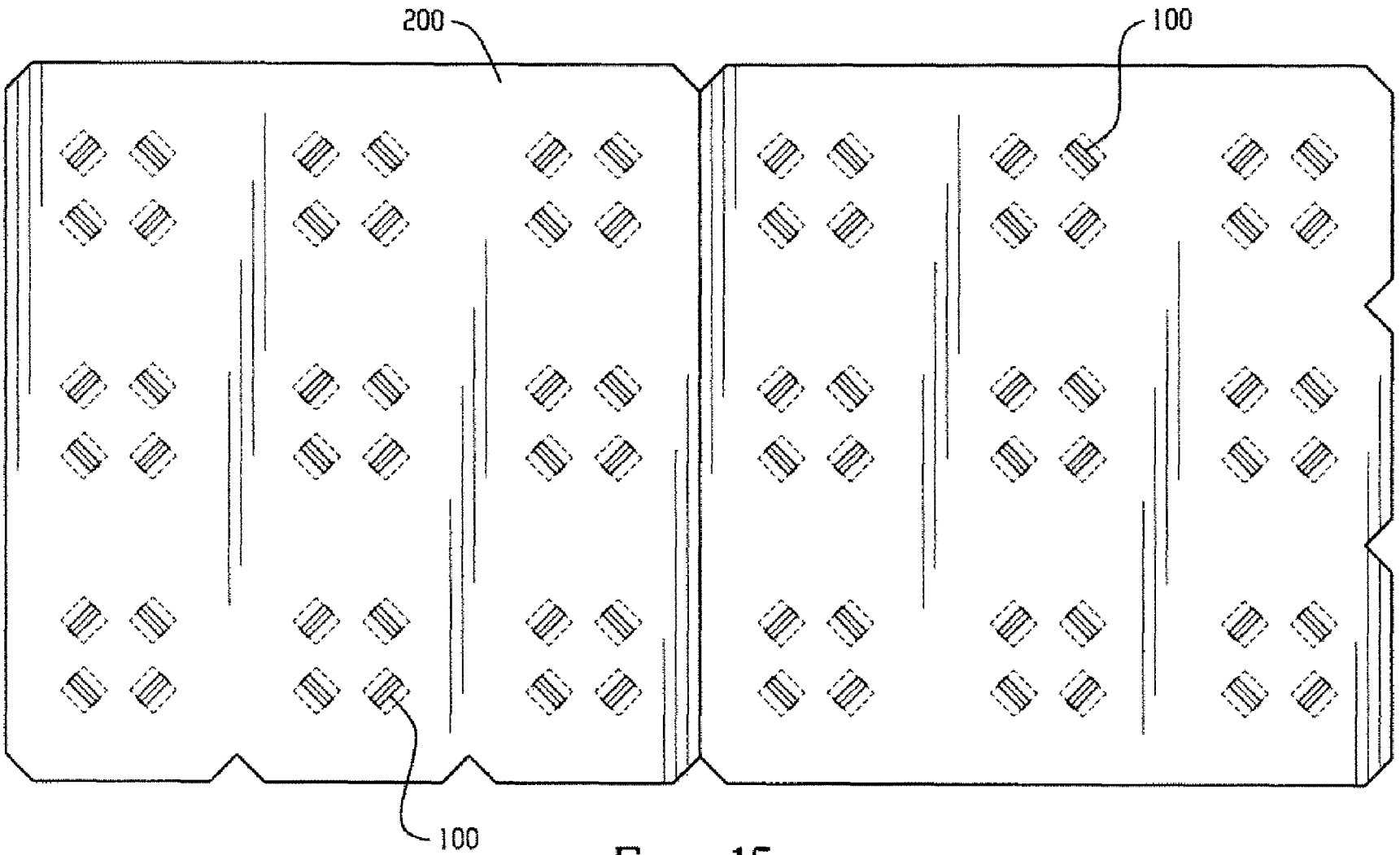
FIG. 15 is a plan view of the middle pads of the packaging assembly of FIG, 11 showing the location of pairs of upwardly extending clips and pairs of downwardly extending clips that may be used in connection with smaller items.
Figure 16:
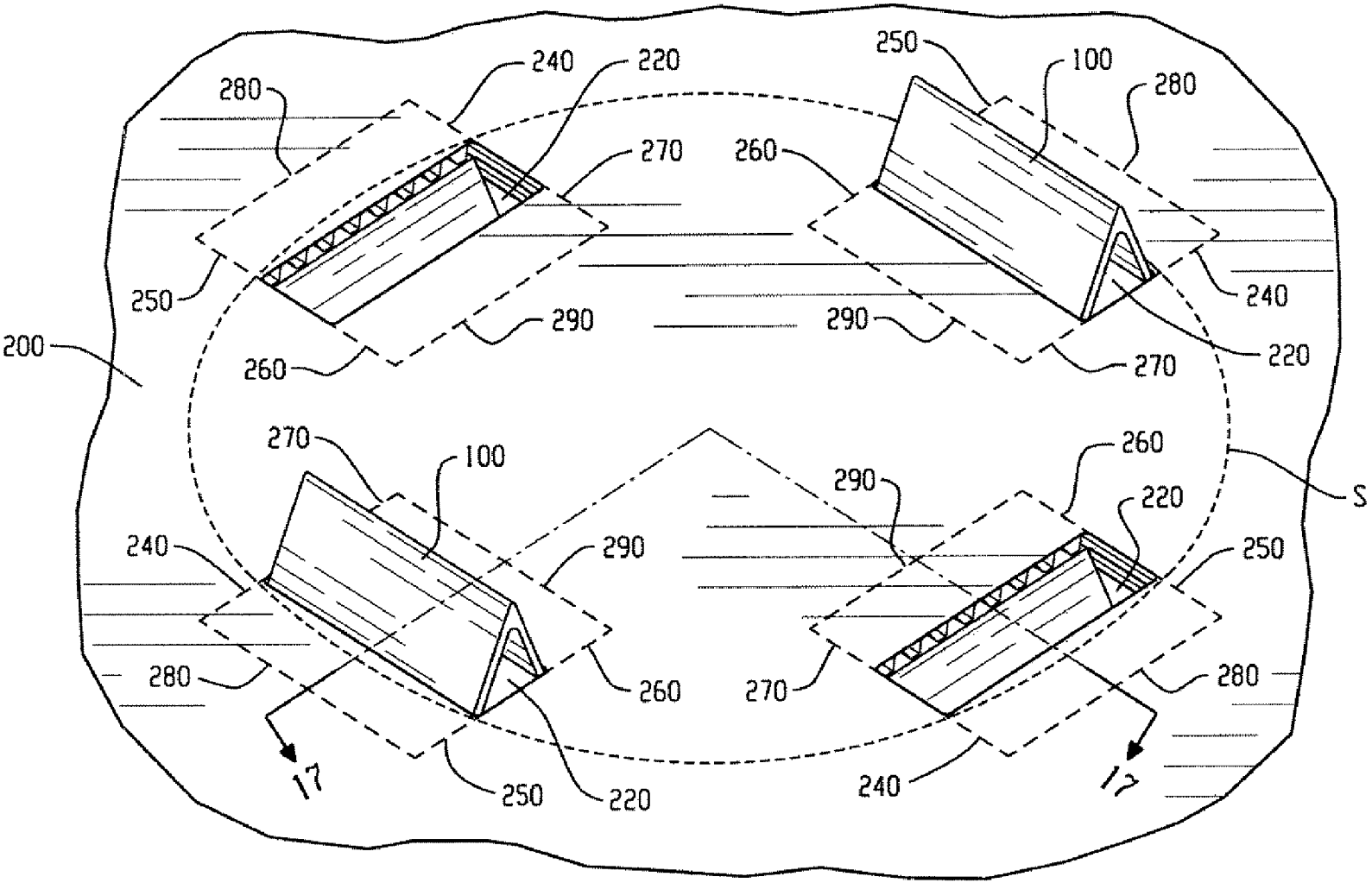
FIG. 16 is a perspective view of a portion of the packaging assembly shown in FIG. 15 showing one set of upwardly extending and downwardly extending clips.
Figure 17:
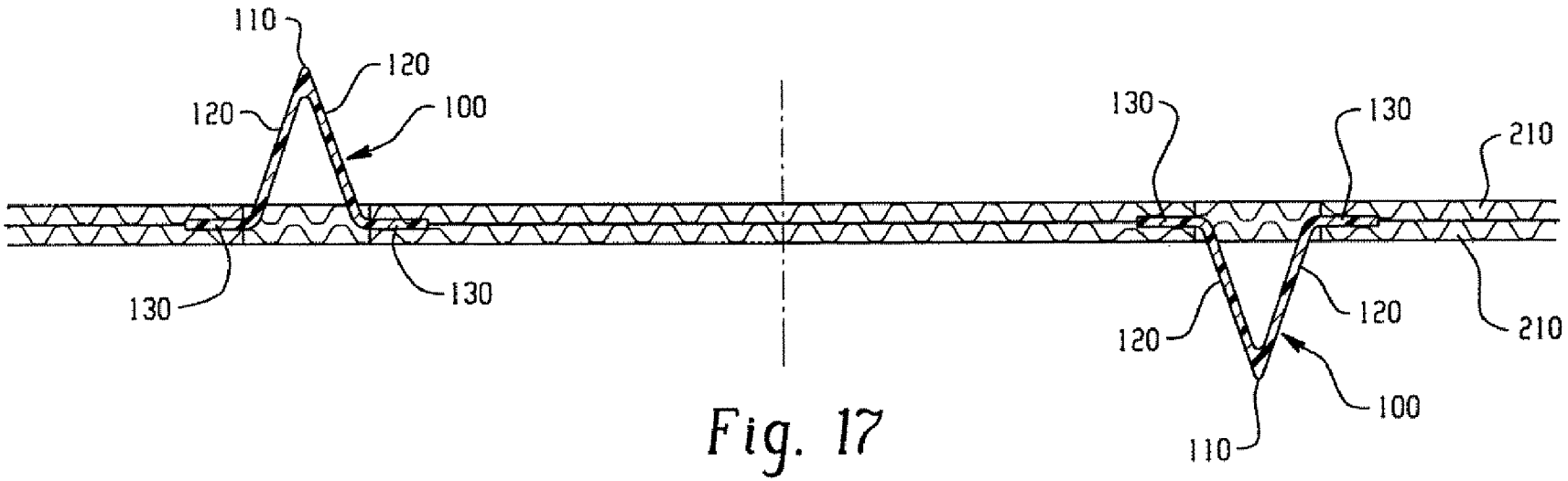
FIG. 17 is a side, sectional view of the packaging assembly of FIG. 16 taken along line 17-17 showing the orientation of upwardly extending and downwardly extending clips used in the packaging assembly of this invention.
Figure 18:
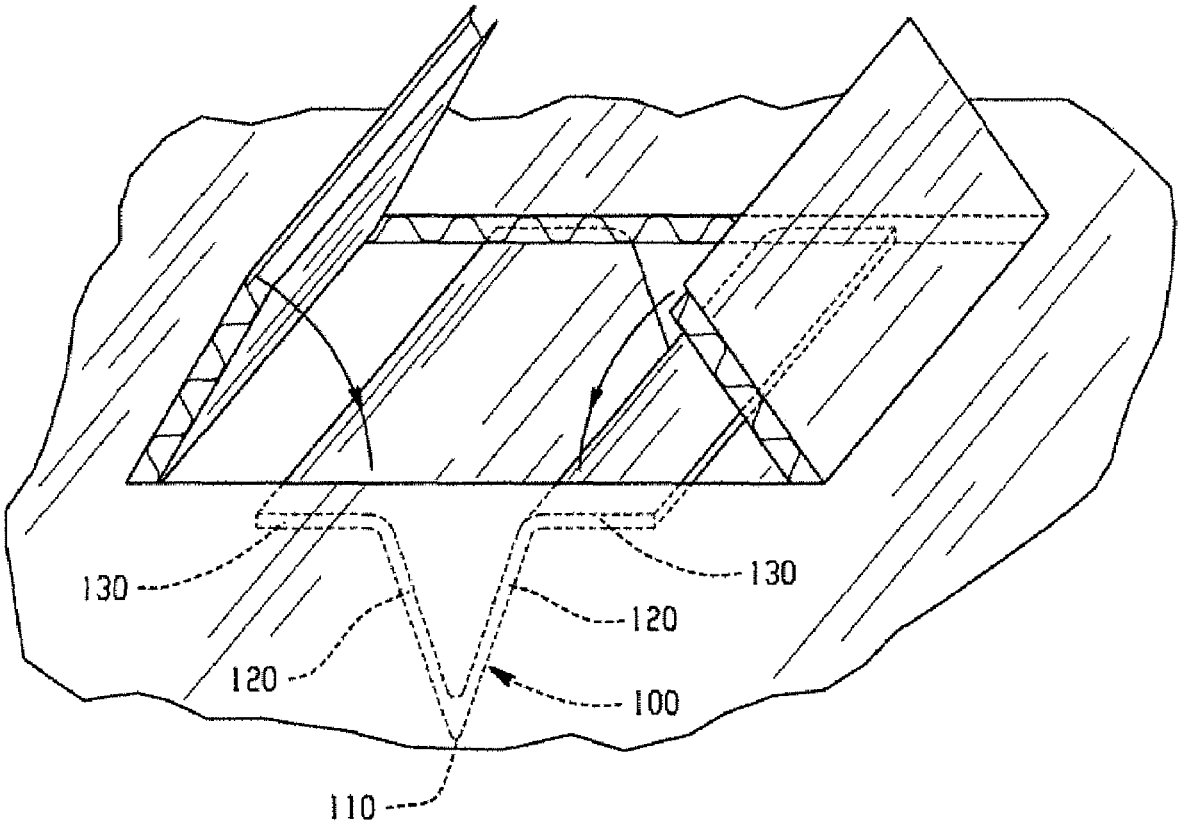
FIG. 18 is an enlarged perspective view of a portion of one of the pads of the packaging assembly of this invention showing removable portions formed therein to facilitate the removal of the clips from the pad allowing the packaging assembly to be recycled.

As with the earlier embodiment, the pad 200 is made of corrugated boards 210 that are secured together by, for example, glue or some other lamination technique. Each corrugated board 210 defines a plurality of cut-outs or apertures 220 at spaced-apart locations. Each aperture 220 is sized to allow clips 100 to extend therethrough and the number and location of apertures 220 are determined by the size and type of item to be shipped with the packaging assembly of this invention. Preferably, two apertures 220 spaced 180 degrees apart are used to position an item having a circular cross-section and a hollow portion adjacent to clips 100. See FIG. 14. Any number of clips may be used to position each item in the packaging assembly. As shown in FIG. 14, eighteen sets of clips 100 are located over the surface of each pad 200. Although each pad in FIG. 14 includes eighteen sets of clips 100, or nine sets per each half of pad 200, it is to be understood that any number of sets of clips 100 could be used depending on the size of the pad 200 used for the packaging assembly of this invention.

The width of apertures 220 should be approximately equal to the width of legs 120 and the length of apertures 220 should be approximately equal to the distance between the outside of the bottoms of legs 120 where feet 130 extend from legs 120. This will ensure that clips 100 will not move laterally with respect to corrugated board 210 and also ensures that the surface of feet 130 will engage and be held in place when two corrugated boards are laminated together. As discussed above, fins 150 may be included on clips 100'" to help hold clips 100'" in place on corrugated board 210. In addition when another corrugated board 210 is laminated to the bottom of the corrugated board 210 above which the clip extends, clips 100 will be secured in place between corrugated boards 210 and will not move out of the plane defined by corrugated boards 210 by virtue of feet 130 being held in place between corrugated boards 210. Preferably apertures 220 have a generally rectangular shape although any other shape could define each aperture 220 as long as the shape provides sufficient room to allow legs 120 of clip 100 to extend therethrough.

Figure 11:
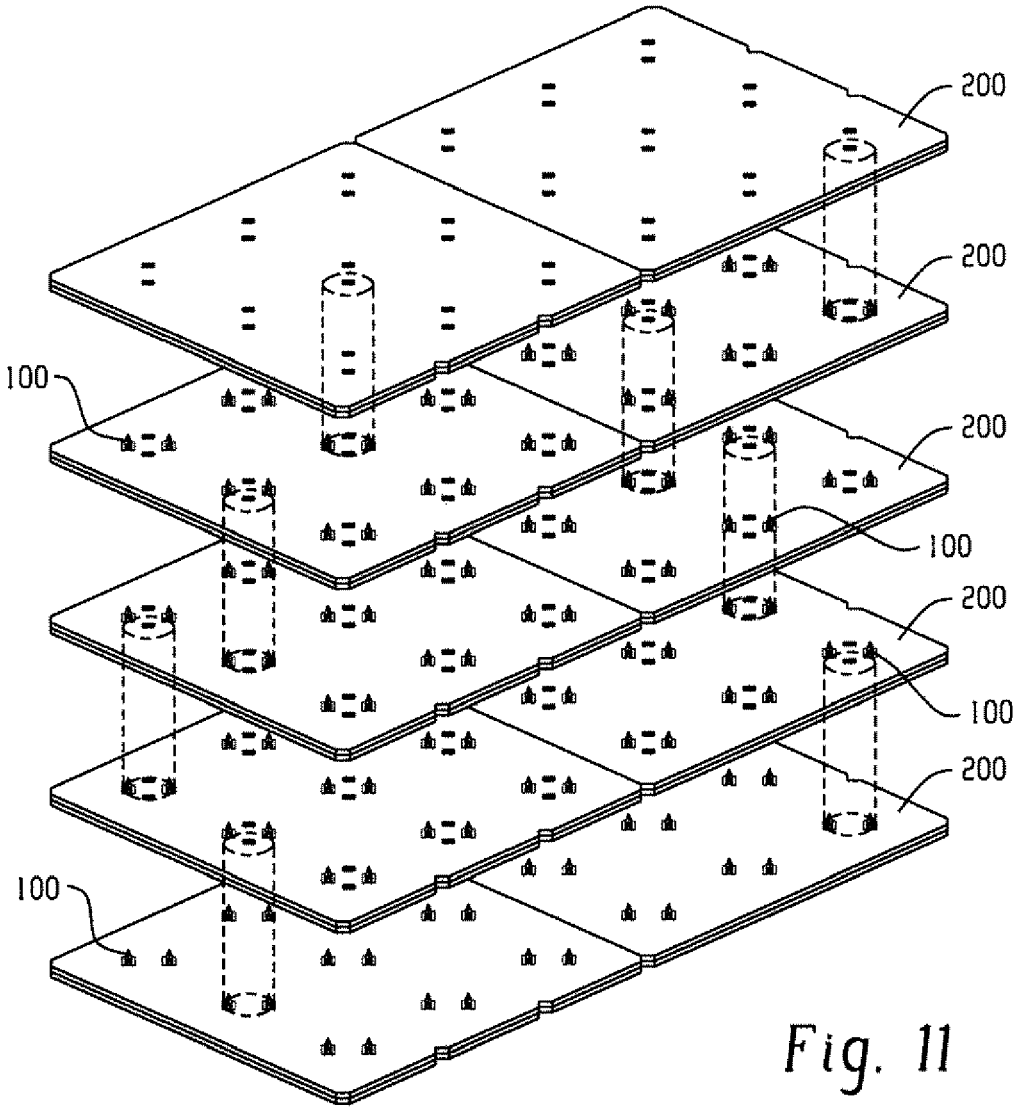
FIG. 11 is a perspective view of an arrangement of a plurality of another embodiment of the packaging assembly of this invention for positioning and retaining smaller items in a shipping container.
Figure 12:
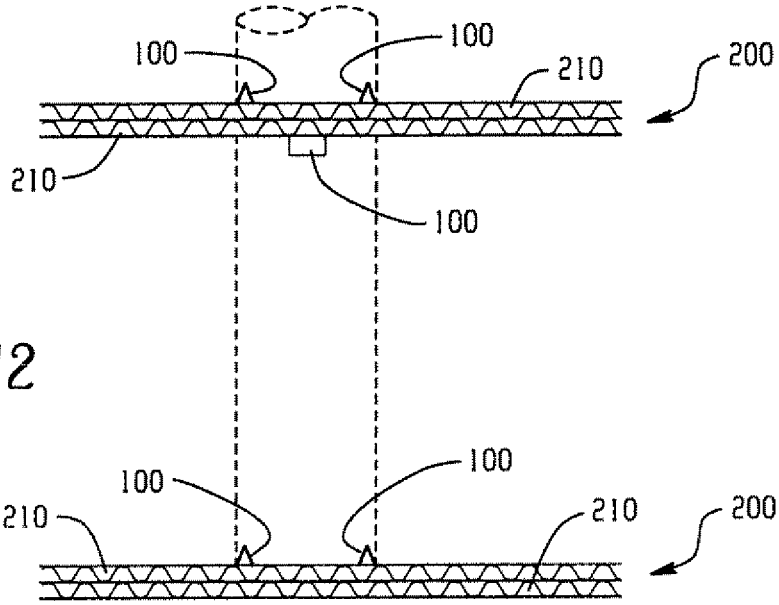
FIG. 12 is a side view of a portion of the packaging assembly of FIG. 11.
Figure 13:
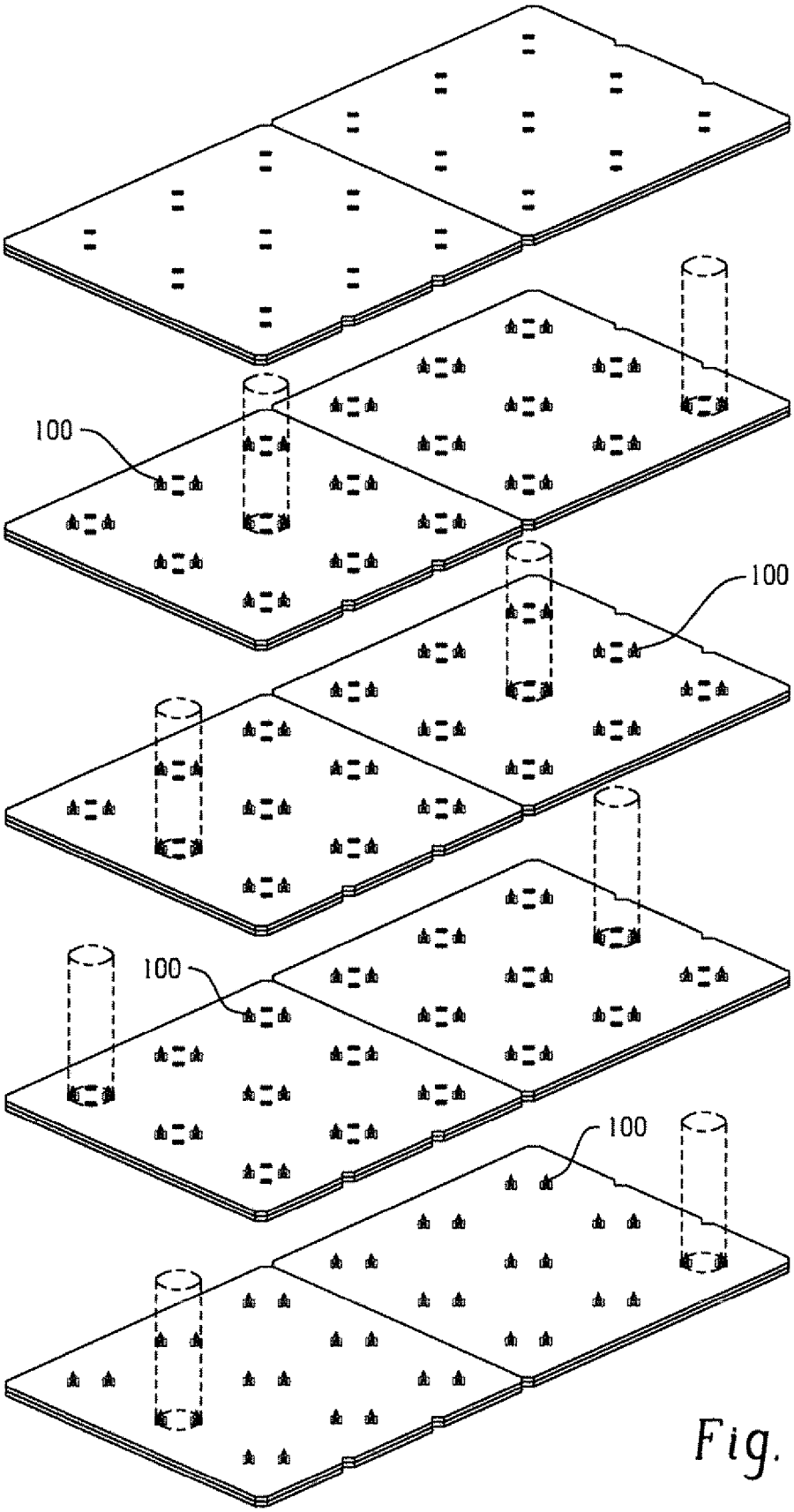
FIG. 13 is an exploded perspective view of the arrangement of a plurality of another embodiment of the packaging assembly of this invention for positioning smaller items in a shipping container.

As shown in FIGS. 11 through 13, the embodiment of the packaging assembly of this invention engages hollow, spool-type items. These items are shown in phantom in FIGS. 11 through 13. As noted above, because the items have a circular cross section, only two clips 100 are needed to engage the bottom portion of each item. In addition, since the item has an open bottom portion, clips 100 are positioned so they engage the inside wall of the item. Thus the distance between the outside legs 120 of clips 100 should be about equal to the inside diameter of the spool items. See line S in FIG. 16, which represents the internal diameter of the spool items. This arrangement of clips 100 is necessary for items such as spools of material where the material is wound on the outside of the spool and engagement by clips 100 on the outside of he item could damage the material wound around the spool.

Figure 19:
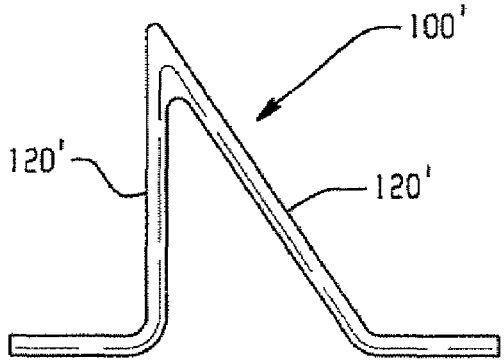
FIG. 19 is an enlarged side elevation view of another embodiment of the clip for use in the packaging assembly of this invention.

Preferably, the inverted V- or U-shaped clips are symmetrical with equal length legs 120 extending from apex 110. This allows easy, self-guiding placement of the spools of material over clips 100. If the spool is slightly off center, legs 120 will move the spool into the proper position as the spool is lowered over clip 100 until the bottom portion of clip 100 engages the inside wall of the spool to hold the spool in place. In addition, this configuration allows proper nesting of multiple clips and pads as described hereinabove. Alternatively, as shown in FIG. 19, one of the legs 120' could be shorter than the other leg. With this type of configuration, shorter leg 120' would have a more vertical orientation so that substantially the entire shorter leg 120' engages the inside wall of the spool. The advantage of this is that there is more surface area of the clip 100' that engages the spool. This ensures a stronger connection between the spool and clip 100' to hold the spool in place.

The shipping container shown in FIGS. 11 and 13 is formed from a plurality of pads 200 with clips 100 located thereon, with the spool of material positioned and held in place on top of each of pads 200, except for the top pad where the spool of material is adjacent to the underside of the top pad. This assembly may then all be wrapped by some shrink wrap material or placed in a shipping container or both for transport or storage to a desired location. As shown in the FIGS., the bottom pad supports a plurality of spools of material thereon. Multiple middle pads may be used with the initial middle pad located on top of the spools of material located on the bottom pad and the other middle pads located below the top pad. It is to be understood that any number, or no, middle pad could be used depending on the number of items to be shipped and the overall size of the packaging assembly desired. The top and bottom pads only have clips extending in one direction from the surface thereof, Thus for the top pad, the clips only extend below the bottom of the pad and for the bottom pad the clips extend only above the top of the pad. See FIGS. 11, 13 and 14.

Figure 20:
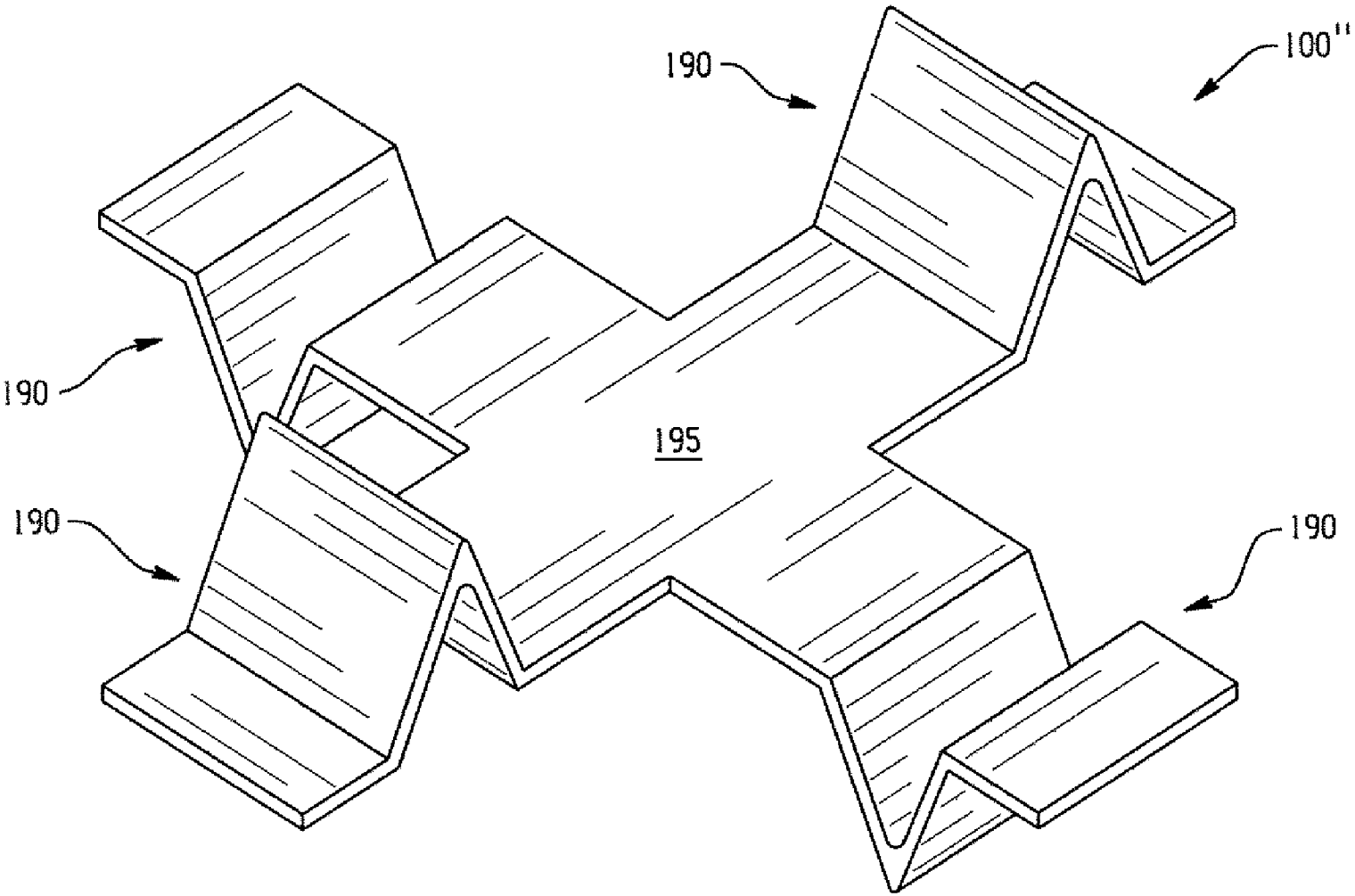
FIG. 20 is an enlarged perspective view of another embodiment of the clip for use in the packaging assembly of this invention.

Each middle pad includes a plurality of clips 100 extending both above the top of the pad and below the bottom of the pad. See FIGS. 12 and 15 through 17. Clips 100 extending below the bottom portion of the pad engage the top portion of the spools in the same manner that the clips extending above the top of the pad engage the bottom portion of the spool. Although not preferred, each of the middle pads could include clips 100 that extend only above the top surface while the top pad could include no clips. Similarly, each of the middle pads could include clips 100 that extend only below the bottom surface while the bottom pad could include no clips. More spools of material are located on the top of each middle pad and are held in place by clips 100 located thereon. This configuration can be used to form a plurality of layers of pads 200 with spools located thereon. Preferably, in each set of clips 100 for the middle pads, four clips 100 are used. These clips 100 are located about 90 degrees apart and alternate between extending above the pad and extending below the pad 200. See FIG. 16. This arrangement allows a plurality of spools to be vertically aligned above and below each pad 200. See FIG. 12. This facilitates packaging the spools in the packaging assembly of this invention. A preferred embodiment for the clip 100" used in the middle pads is shown in FIG. 20. Clip 100" is formed as an integral unit and has four main segments 190 each forming a substantially V-shape and extending from a main body portion 195. Each adjacent segment 190 has its apex in a different orientation, i.e. so that main segments 190 that are across from each other extend in the same direction but each adjacent main segment 190 extends in the opposite direction. Each main segment 190 may have a configuration substantially the same as the other embodiments of the clip, i.e. V-shaped, U-shaped, with a ledge or without a ledge. Alternatively, each main segment could have a different configuration.

In order to facilitate recycling of the paperboard material used for corrugated boards 210, each corrugated board 210 can be formed with perforation lines 240, 250, 260 and 270 adjacent to each aperture 220. See FIGS. 16 and 18. Perforation lines 240 and 250 extend from one side of each aperture 220 while perforation lines 260 and 270 extend from the other side of each aperture 220. In addition, fold lines or additional perforation lines 280 and 290 are used to connect perforation lines 240, 250 and 260, 270 respectively. Each set of perforation lines 240 and 250 on one hand and 260 and 270 on the other hand allows a user to easily tear and move away the portion of corrugated board 210 located between aperture 220 and each set of perforation lines. Perforation lines 280 and 290 facilitate the complete removal of that material. This in turn allows easy removal of clips 100 from pads 200. See FIG. 18. Preferably, the space defined between one side of aperture 220 and one set of perforation lines is about equal to the area defined by each foot 130 of clip 100. Alternatively, only one set of perforation lines needs to be used as long as the space defined by aperture 220 and the space in between the perforation lines is about equal to the area defined by one foot 130. With some manipulation, this space may still be sufficient to allow each clip 100 to be removed from each pad 100.

Figure 21:
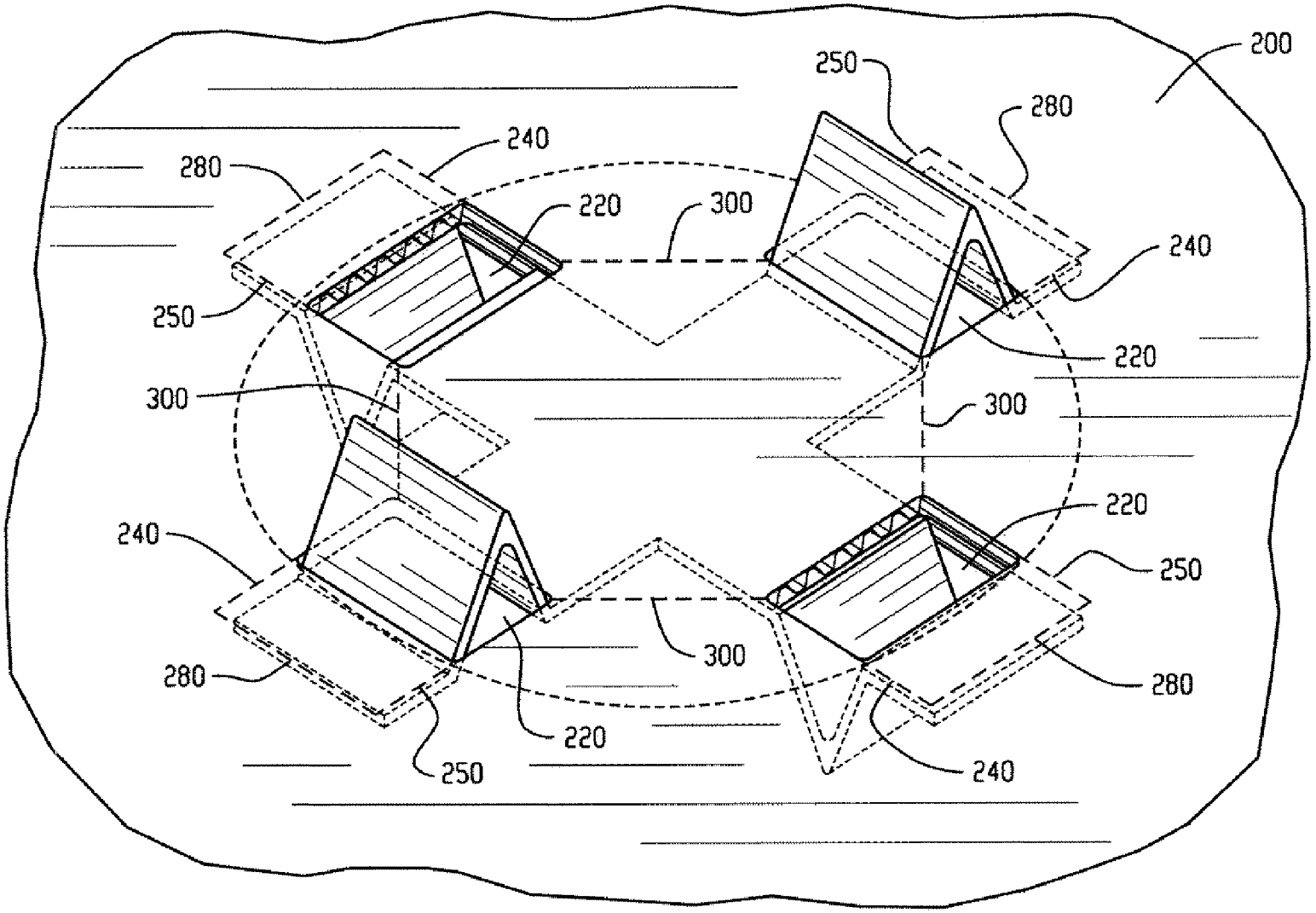
FIG. 21 is an enlarged perspective view of a portion of one of the pads of the packaging assembly of this invention employing the clip shown in FIG. 20.

In an alternate embodiment shown in FIG. 21, perforation lines 300 can extend from the inner corner of each adjacent aperture 220 to the inner corner of the nearest adjacent aperture 220. This configuration is suitable for use with the clip of FIG. 20, to ensure that main body portion 195 may be removed from corrugated board 210.

It should be emphasized that the above-described embodiments of the present invention, particularly, any "preferred" embodiments, are merely possible examples of implementations, merely set forth for a clear understanding of the principles of the invention, Many variations and modifications may be made to the above-described embodiment(s) of the invention without departing substantially from the spirit and principles of the invention. All such modifications and variations are intended to be included herein within the scope of this disclosure and the present invention and protected by the following claims.

I claim:

1. A packaging assembly, comprising:

a pad including at least two corrugated boards which are secured together wherein one of the corrugated boards includes a plurality of apertures therein; and a plurality of clips secured to the boards, each clip extending through one of the plurality of apertures, wherein the clips are at spaced apart locations and are adapted and disposed with a planar surface portion to engage a surface of an item to be shipped with the packaging assembly, each of the clips defined by two legs with a foot on each leg that projects outwardly from the legs, each foot being sandwiched between the two corrugated boards to hold the clip in position;

wherein each respective planar surface portion of the plurality of clips faces a different direction and toward a common area of the pad.

2. The packaging assembly of claim 1 wherein the plurality of clips is subdivided into a plurality of sets of clips wherein each set of clips is adapted to engage a surface of an item to be shipped with the packaging assembly.

3. The packaging assembly of claim 2 wherein each aperture has a length and a width and wherein the corrugated board defining the aperture includes a plurality of perforation lines adjacent to each aperture such that the perforation lines are generally aligned with an edge of the aperture and are spaced apart a distance substantially the same as the width of the aperture.

4. The packaging assembly of claim 2 wherein the pad defines an upper surface and a bottom surface, the plurality of apertures extend through the pad and the plurality of clips extend through the aperture such that some of the clips extend above the upper surface of the pad and some of the clips extend below the bottom surface of the pad.

5. The packaging assembly of claim 4 wherein each set of clips includes a pair of clips that extend above the upper surface of the pad and a pair of clips that extend below the surface of the pad.

6. The packaging assembly of claim 5 wherein the clips are disposed about 90 degrees apart relative to a common area of the pad and each adjacent clip is in a different orientation relative to a neighboring clip and the clips that are about 180 degrees apart are in substantially the same orientation.

7. The packaging assembly of claim 1 wherein each clip includes a fin projecting from at least one of the legs that engages a surface of a corrugated board not contacted by the foot of the clip.

8. The packaging assembly of claim 1 wherein the clips are adapted to engage an internal surface of the item to be shipped with fie packaging assembly.

9. The packaging assembly of claim 1 wherein at least one of the plurality of clips comprises a ledge projecting outwardly from one of the legs, the ledge being disposed between a top of the respective leg and a bottom of the respective foot.

10. The packaging assembly of claim 1 wherein at least one of the plurality of clips comprises projection extending outwardly from an end of the clip opposite the respective feet.

11. A packaging assembly, comprising:

a pad including at least two corrugated boards which are secured together wherein one of the corrugated boards includes a plurality of apertures therein; and a plurality of sets of clips secured to the boards, each set of clips is formed as an integral unit extending from a main body portion, each clip extends through one of the plurality of apertures, is adapted and disposed with a planar surface portion to engage a surface of an item to be shipped with the packaging assembly and is defined by two legs with a free foot on one leg that projects outwardly from the leg and a connecting foot connecting the clip to the main body portion, each foot and the main body portion being sandwiched between the two corrugated boards to hold each set of clips in position;

wherein each respective planar surface portion faces a different direction and toward a common area of the main body portion.

12. The packaging assembly of claim 11 wherein the pad defines an upper surface and a bottom surface, the plurality of apertures extend through the pad and the plurality of clips extend through the aperture such that some of the clips extend above the upper surface of the pad and some of the clips extend below the bottom surface of the pad.

13. The packaging assembly of claim 12 wherein each set of clips includes a pair of clips that extend above the upper surface of the pad and a pair of clips that extend below the surface of the pad.

14. The packaging assembly of claim 13 wherein the clips are disposed about 90 degrees apart relative to a common area of the pad and each adjacent clip is in a different orientation relative to a neighboring clip and the clips that are about 180 degrees apart are in substantially the same orientation.

15. The packaging assembly of claim 11 wherein each aperture is arranged in a plurality of sets of apertures such that each set of apertures includes four apertures spaced about 90 degrees apart relative to a common area of the pad and each aperture defines inner corners and outer corners and wherein the corrugated board defining the aperture further includes a plurality of perforation lines adjacent to each aperture such that the perforation lines extend from an inner corner of one aperture to the nearest inner corner of an adjacent aperture.

16. The packaging assembly of claim 15 wherein each aperture has a length and a width and wherein the corrugated board defining the aperture includes a plurality of perforation lines adjacent to each aperture such that each perforation lines is generally aligned with an edge of the aperture and extends from an outer corner of the aperture.

17. A packaging assembly, comprising:

a plurality of pads, including a top pad, at least one middle pad and a bottom top pad, each pad defined by at least two corrugated boards which are secured together;

a plurality of clips secured to the boards and arranged to engage an item to be shipped with the packaging assembly, wherein the clips are at spaced apart locations and engage a surface of the item to be shipped, each of the clips having two legs with a foot on each leg that projects outwardly from the legs, each foot being sandwiched between the two corrugated boards to hold the clip in position; and the at least one middle pad has a plurality of clips extending toward the top pad and a plurality of clips extending toward the bottom pad.

18. The packaging assembly of claim 17 wherein the top pad has a plurality of clips extending toward the bottom pad and the bottom pad has a plurality of clips extending toward the top pad.

19. The packaging assembly of claim 18 wherein the plurality of clips in the at least one middle pad is arranged as a plurality of sets of clips and each set of clips is formed as an integral unit extending from a main body portion and one foot is a free foot on one leg that projects outwardly from the leg and the other foot is a connecting foot connecting the clip to the main body portion.

* * * * *